US010808913B1

(12) United States Patent
Pitcher et al.

(10) Patent No.: US 10,808,913 B1
(45) Date of Patent: Oct. 20, 2020

(54) FLAGPOLE LIGHTING SYSTEM AND DEVICE

(71) Applicants: Daniel J. Pitcher, Wimberley, TX (US); Lisa M. Pitcher, Wimberley, TX (US)

(72) Inventors: Daniel J. Pitcher, Wimberley, TX (US); Lisa M. Pitcher, Wimberley, TX (US)

( * ) Notice: Subject to any disclaimer, the term of this patent is extended or adjusted under 35 U.S.C. 154(b) by 0 days.

(21) Appl. No.: 16/730,889

(22) Filed: Dec. 30, 2019

(51) Int. Cl.

| | |
|---|---|
| ***G09F 17/00*** | (2006.01) |
| ***F21V 7/00*** | (2006.01) |
| ***F21V 21/00*** | (2006.01) |
| ***F21V 7/06*** | (2006.01) |
| ***F21V 7/04*** | (2006.01) |
| *F21Y 115/10* | (2016.01) |

(52) U.S. Cl.
CPC ..... *F21V 7/0008* (2013.01); *F21V 7/045* (2013.01); *F21V 7/06* (2013.01); *F21V 21/00* (2013.01); *F21Y 2115/10* (2016.08)

(58) Field of Classification Search
CPC ..... F21V 21/116; F21Y 2107/10; F21S 8/088; G09F 17/00
See application file for complete search history.

(56) References Cited

U.S. PATENT DOCUMENTS

| | | | | |
|---|---|---|---|---|
| 3,752,975 | A | 8/1973 | Meyer | |
| 6,142,651 | A | 11/2000 | Thompson | |
| 6,227,683 | B1 | 5/2001 | Tukia | |
| 6,698,122 | B1 | 3/2004 | Merenlender | |
| 6,955,456 | B2 | 10/2005 | Schroeder | |
| D535,584 | S | 1/2007 | Garrett | |
| 7,275,495 | B2 | 10/2007 | Lawrence et al. | |
| 8,057,078 | B1 | 11/2011 | Ko | |
| 8,069,811 | B2 | 12/2011 | Ciaccia | |
| 8,215,807 | B1 | 7/2012 | Brunesti | |
| 8,746,928 | B2 | 6/2014 | Morris et al. | |
| 8,973,517 | B1 | 3/2015 | Bort | |
| 9,316,365 | B1 * | 4/2016 | Ko | F21V 21/116 |
| 9,396,673 | B2 | 7/2016 | Bort | |
| 9,863,592 | B2 | 1/2018 | Toner | |
| 10,107,465 | B2 | 10/2018 | Toner | |
| 2005/0083693 | A1 | 4/2005 | Garrett | |
| 2005/0247257 | A1 * | 11/2005 | Lawrence | G09F 17/00 116/174 |
| 2008/0013306 | A1 | 1/2008 | Guilmette | |
| 2012/0314404 | A1 * | 12/2012 | Harshaw | F21V 7/0025 362/183 |
| 2015/0009659 | A1 | 1/2015 | Werner et al. | |
| 2018/0313108 | A1 | 11/2018 | Ciaccia | |

* cited by examiner

*Primary Examiner* — Andrew J Coughlin
(74) *Attorney, Agent, or Firm* — Olav M. Underdal; IDP Patent Services

(57) ABSTRACT

A flagpole lighting device includes a mounting stem, a dome assembly including an illumination dome and at least one light source; a mounting structure with a central portion and mounting arms; and mounting receptacles each including a receptacle fastener, a receptacle body, and body flanges; such that the flagpole lighting device is configured to be connected to a flagpole truck that is mounted on a top of a flagpole, such that the flagpole lighting device provides lighting for a flag mounted on the flagpole.

20 Claims, 6 Drawing Sheets

Flagpole lighting system

FLAGPOLE LIGHTING SYSTEM AND DEVICE

CROSS-REFERENCE TO RELATED APPLICATIONS

N/A.

FIELD OF THE INVENTION

The present invention relates generally to the field of flagpole accessories, and more particularly to methods and systems for illuminating a flag of a flagpole.

BACKGROUND OF THE INVENTION

American flags should be displayed from sunrise to sunset every day according to the U.S. Flag Code. However, if a flag owner wants to display a flag during nighttime, this is permissible as long as the flag is illuminated.

Lighting systems for flags are available but they are typically ground mounted, which tends to cause inefficient illumination of the flag. Additionally, such ground mounted lighting systems are not eligible for DARK SKY™ certification. There are some lighting systems available for down-light mounting on a top end of the flagpole, but the mounting structure of such systems tend to obscure and interfere with efficient illumination of the flag.

As such, considering the foregoing, it may be appreciated that there continues to be a need for novel and improved devices and methods for illuminating a flag of a flagpole.

SUMMARY OF THE INVENTION

The foregoing needs are met, to a great extent, by the present invention, wherein in aspects of this invention, enhancements are provided to the existing model of illuminating a flag of a flagpole.

In an aspect, a flagpole lighting device can include:

a) A mounting stem, which can be connected to a flagpole truck that is mounted on a top of a flagpole; and b) A dome assembly with an illumination dome, such that the dome assembly is connected to a top end of the mounting stem; wherein the dome assembly can further include:

at least one light source, which can be mounted on an inner surface of the illumination dome;

such that light from the lighting source is reflected in the illumination dome, such that the flagpole lighting device provides lighting for a flag mounted on the flagpole.

In a related aspect, the flagpole lighting device can further include:

a mounting structure, which connects to on an inner surface of the illumination dome, such that a top end of the mounting stem connects to a central portion of the mounting structure.

In a further related aspect, the mounting structure can further include:

a plurality of mounting arms, that extend radially from the central portion of the mounting structure, such that an outer end of each of the mounting arms is connected to the inner surface of the illumination dome.

In a yet further related aspect, the dome assembly can further include:

a plurality of mounting receptacles, which are mounted on the inner surface of the illumination dome, such that an outer end of each of the mounting arms is connected to a corresponding mounting receptacle.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
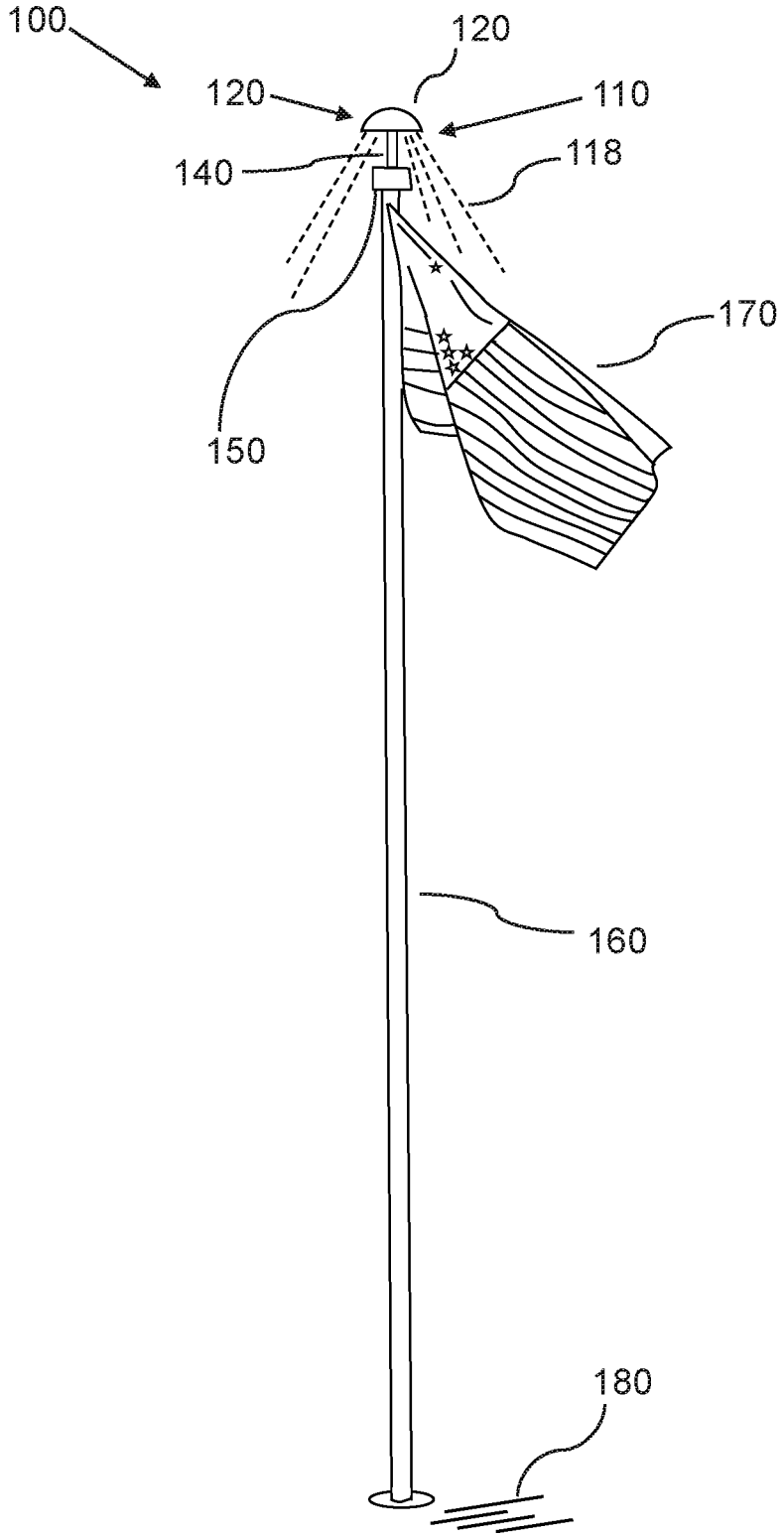
FIG. 1 is a perspective view of a flagpole lighting system, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a flagpole lighting system 100 with reference to FIG. 1, in such manner that like reference numerals refer to like components throughout; a convention that we shall employ for the remainder of this specification.

In an embodiment, as shown in FIG. 1, a flagpole lighting system 100 can include:

a) A flagpole 160, such that a lower end of the flagpole 160 can be mounted on a ground surface 180;

b) A flagpole truck 150, which is mounted on a top end of the flagpole 160;

c) A flag 170, which is mounted on a top part of the flagpole 160; and d) A flagpole lighting device 110, which is connected to a top of the flagpole truck, such that the flagpole lighting device 110 illuminates the flag 170.

In a related embodiment, as shown in FIGS. 2A, 2B, 3A, 3B, and 3C, a flagpole lighting device 110 can include:

a) A mounting stem 140, which is configured to be connected to a top of a flagpole 160, such as for example configured to a top of a flagpole truck 150 that is mounted on a top of a flagpole 160, wherein the mounting stem 140 can be an elongated tube, which can be circular, or alternatively for example rectangular or oval, and can be hollow; and b) A dome assembly 120, which comprises an illumination dome 121, which is connected to a top end of the mounting stem 140, wherein the illumination dome 121 can be configured with a reflective inner surface 224; wherein the dome assembly 120 can further include:

i. at least one light source 228, which can be mounted on an inner surface 224 of the illumination dome 121. In general, the light source 228 can be mounted inside (i.e. within) the illumination dome 121, i.e. in the interior of the illumination dome 121 between an opening 222 and an inner surface 224 of the illumination dome 121;

wherein the dome assembly 120 can be connected to a top end of the mounting stem 140;

such that the dome assembly 120 is configured to be positioned with an opening 222 of the illumination dome 121 pointing downward, when a lower end of the mounting stem 140 is connected to the flagpole truck 150;

such that light 118 from the at least one light source 228 is directed downward by the illumination dome 121, such that the flagpole lighting device provides lighting for a flag mounted on the flagpole, and such that the illumination dome 121 prevents emissions of upward directed light 118.

The illumination dome 121 can also be referred to as a reflector dome 121. In related embodiments, the illumination dome 121 can be made from a material that does not transmit light, such as an opaque or reflective material, including metals and suitable plastic materials, and can include a reflective or semi-reflective inner coating. The inner surface 224 of the illumination dome 121 can be concave or substantially concave.

In a related embodiment, the illumination dome 121 can be configured as a parabolic reflector 121, which can be shaped as a segment of a circular paraboloid; or the illumination dome 121 can be configured as a spherical reflector 121, which is shaped as a segment of a sphere.

In a related embodiment, the flagpole lighting device 110 can further include:

a mounting structure 230, which comprises a central portion 334, wherein the mounting structure 230 can be connected to on an inner surface 224 of the illumination dome 121, such that a top end of the mounting stem 140 can be connected to the central portion 334 of the mounting structure 230.

In a further related embodiment, the mounting structure 230 can further include:

a plurality of mounting arms 336, that extend radially from the central portion of the mounting structure 230 such that an outer end of each of the mounting arms 336 is connected to the inner surface 224 of the illumination dome 121;

such that the mounting arms 336 can be symmetrically positioned around the central portion. The plurality of mounting arms can be three mounting arms that are symmetrically positioned around the central portion (i.e. with intersection angles of 120 degrees).

In a yet further related embodiment, the dome assembly 120 can further include:

a plurality of mounting receptacles 324, which are mounted on the inner surface 224 of the illumination dome 121, such that an outer end of each of the mounting arms 336 is connected to a corresponding mounting receptacle 324.

Figure 3A:
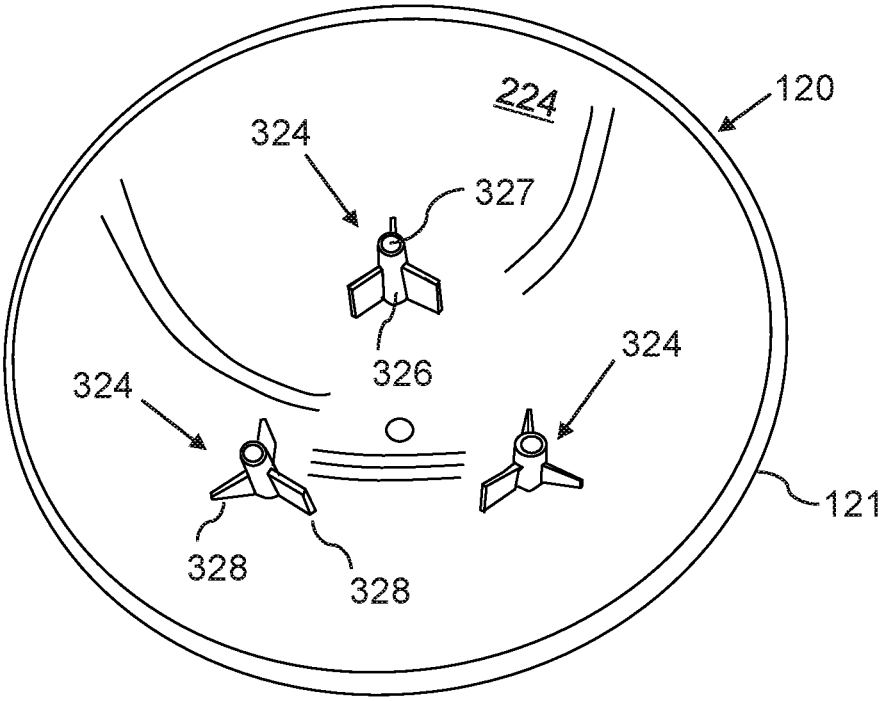
FIG. 3A is a perspective view of parts of a flagpole lighting device, according to an embodiment of the invention.
Figure 3A:
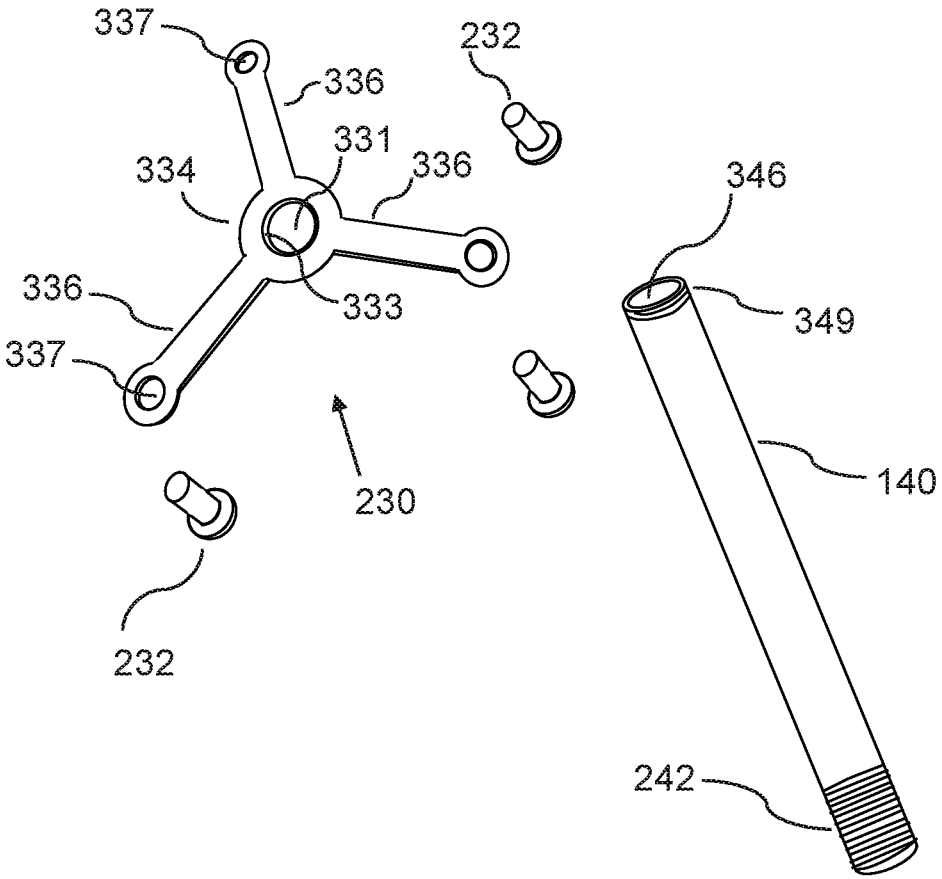
Figure 3B:
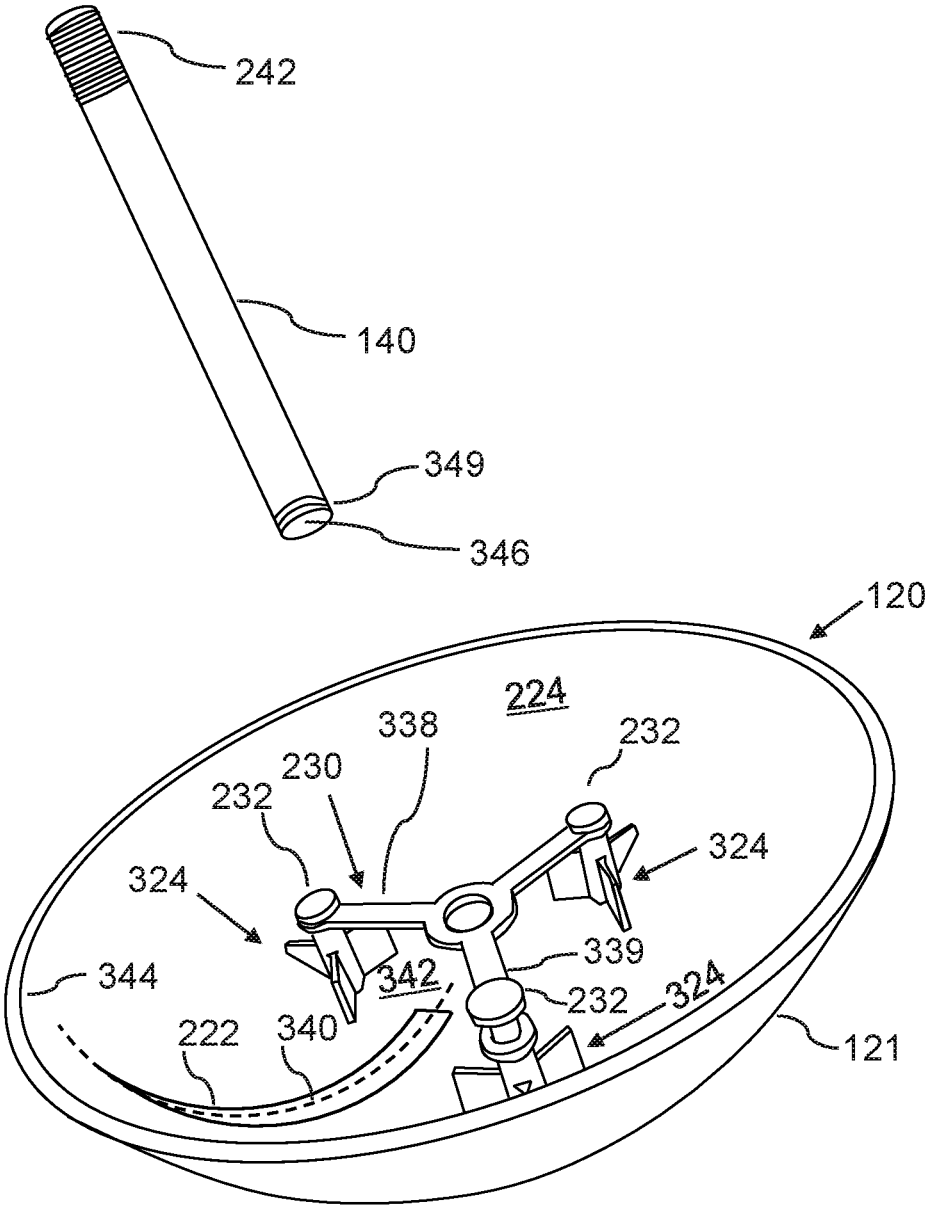
FIG. 3B is a perspective view of a flagpole lighting device in a partially assembled state, according to an embodiment of the invention.

In a further related embodiment, as shown in FIGS. 3A and 3B, each mounting receptacle 324 can further include:

a) a receptacle fastener 232, which can be a receptacle plug 232 or receptacle screw 232;

b) a receptacle body 326, which includes a receptacle aperture 327, wherein the receptacle body 326 can be a hollow tube; and c) at least one body flange 328, which is connected to the receptacle body 326 and to the inner surface 224 of the illumination dome 121, such that the at least one body flange stabilizes the receptacle body 326;

wherein an outer end of each of the mounting arms 336 comprises a mounting aperture 337;

wherein an outer end of each of the mounting arms 336 is connected to the receptacle body 326, such that the receptacle fastener 232 protrudes through the mounting aperture 337 and into the receptacle aperture 327. The receptacle fastener 232 can screw into the receptacle aperture 327 or it can be a receptacle plug 232, which is permanently glued into the receptacle aperture 327, for example using a PVC adhesive, such as "plumbing glue", or a solvent cement.

Figure 3C:
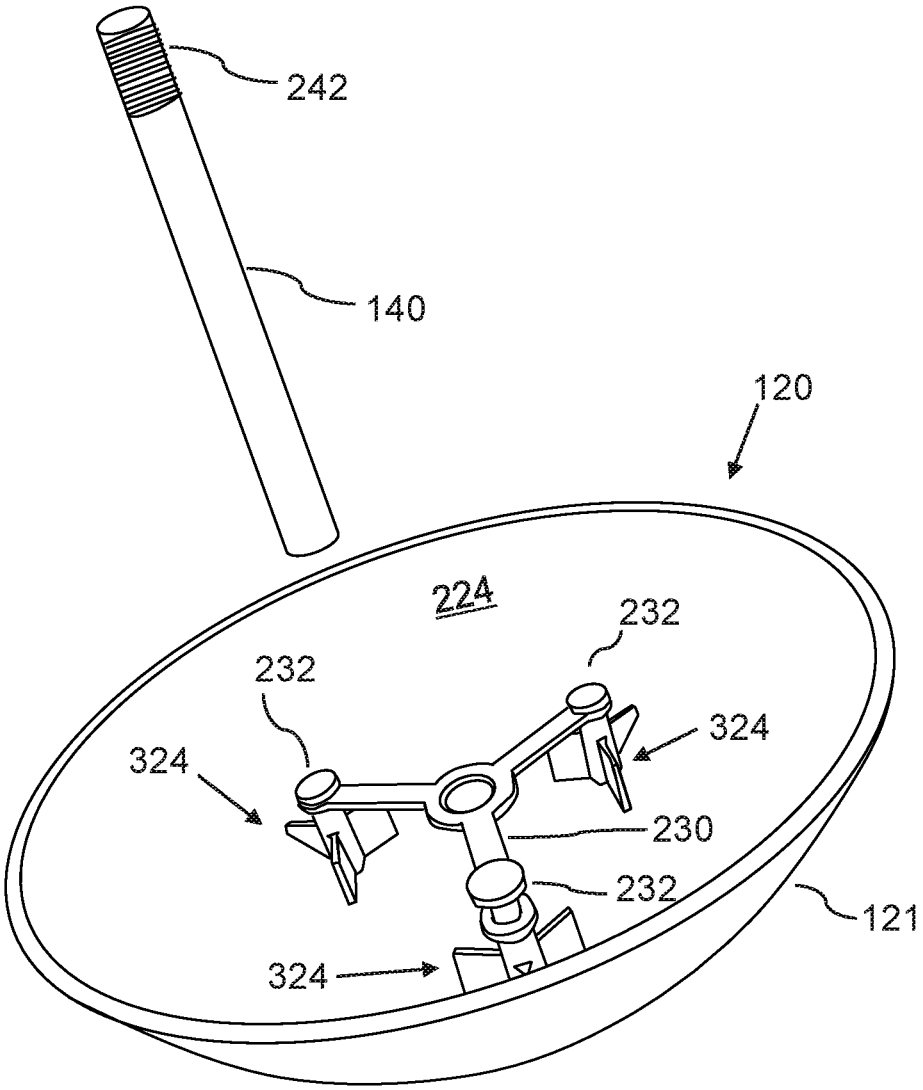
FIG. 3C is a perspective view of a flagpole lighting device in an assembled state, according to an embodiment of the invention.

In a further related embodiment, as shown in FIGS. 3B and 3C, the central portion of the mounting structure 230 can further include a central aperture 331, which includes a female threading 333;

wherein the mounting stem 140 is hollow, such that the mounting stem 140 comprises a stem aperture 346, which protrudes through the mounting stem 140;

wherein a top end of the mounting stem 140 comprises a male threading 349; wherein a top end of the mounting stem 140 is connected to the central portion of the mounting structure 230, such that the top end of the mounting stem 140 is screwed into the central aperture 331 of the mounting structure 230.

Figure 2A:
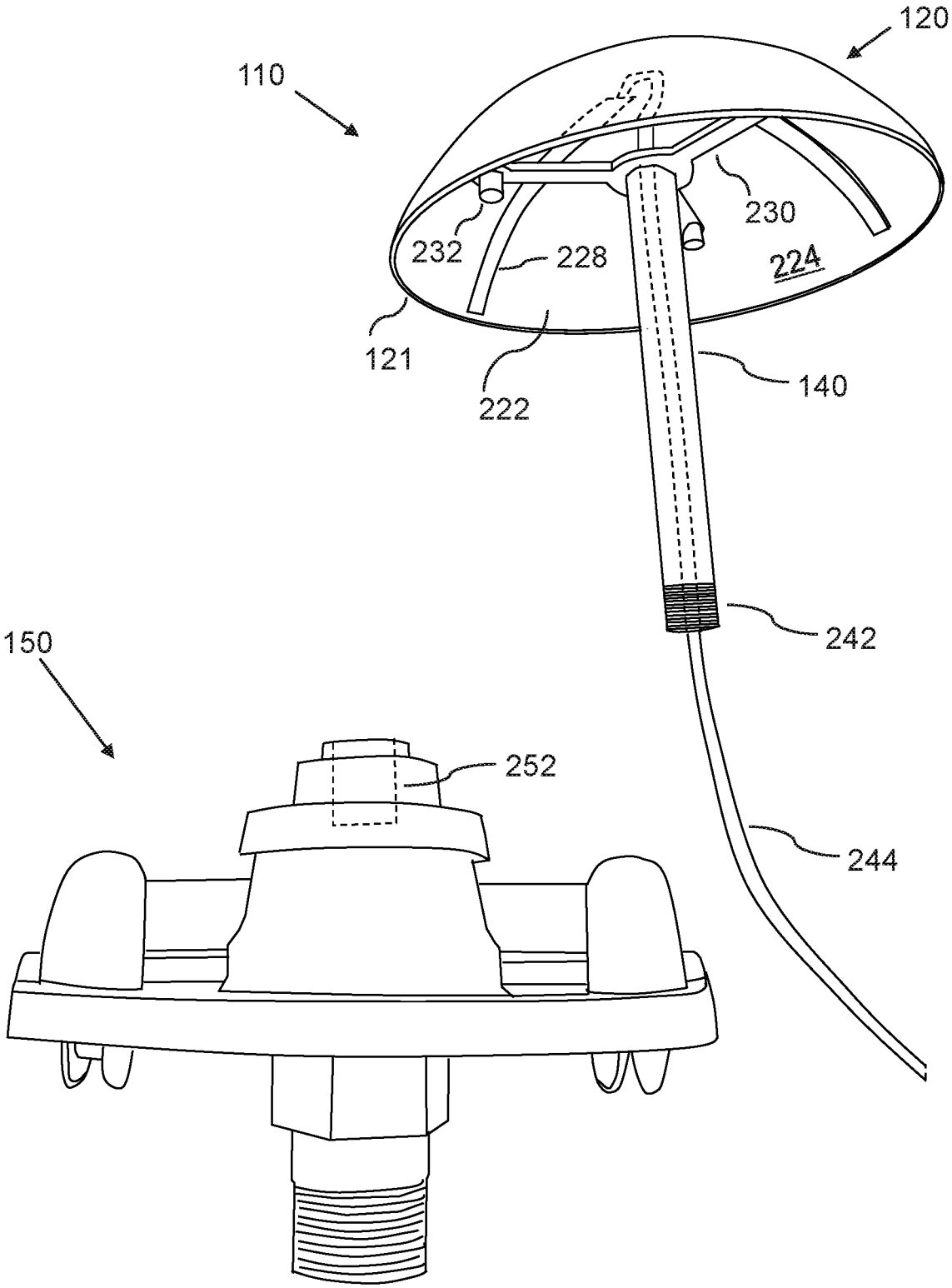
FIG. 2A is a perspective view of a flagpole lighting device and a flagpole truck prior to installation, according to an embodiment of the invention.

In a yet further related embodiment, as shown in FIG. 2A, the flagpole lighting device 110 can further include a power wire 244, which can protrude through the mounting stem 140 and the central aperture 331 of the mounting structure 230, such that the power wire 244 is connected to the at least one light source 228.

Figure 2B:
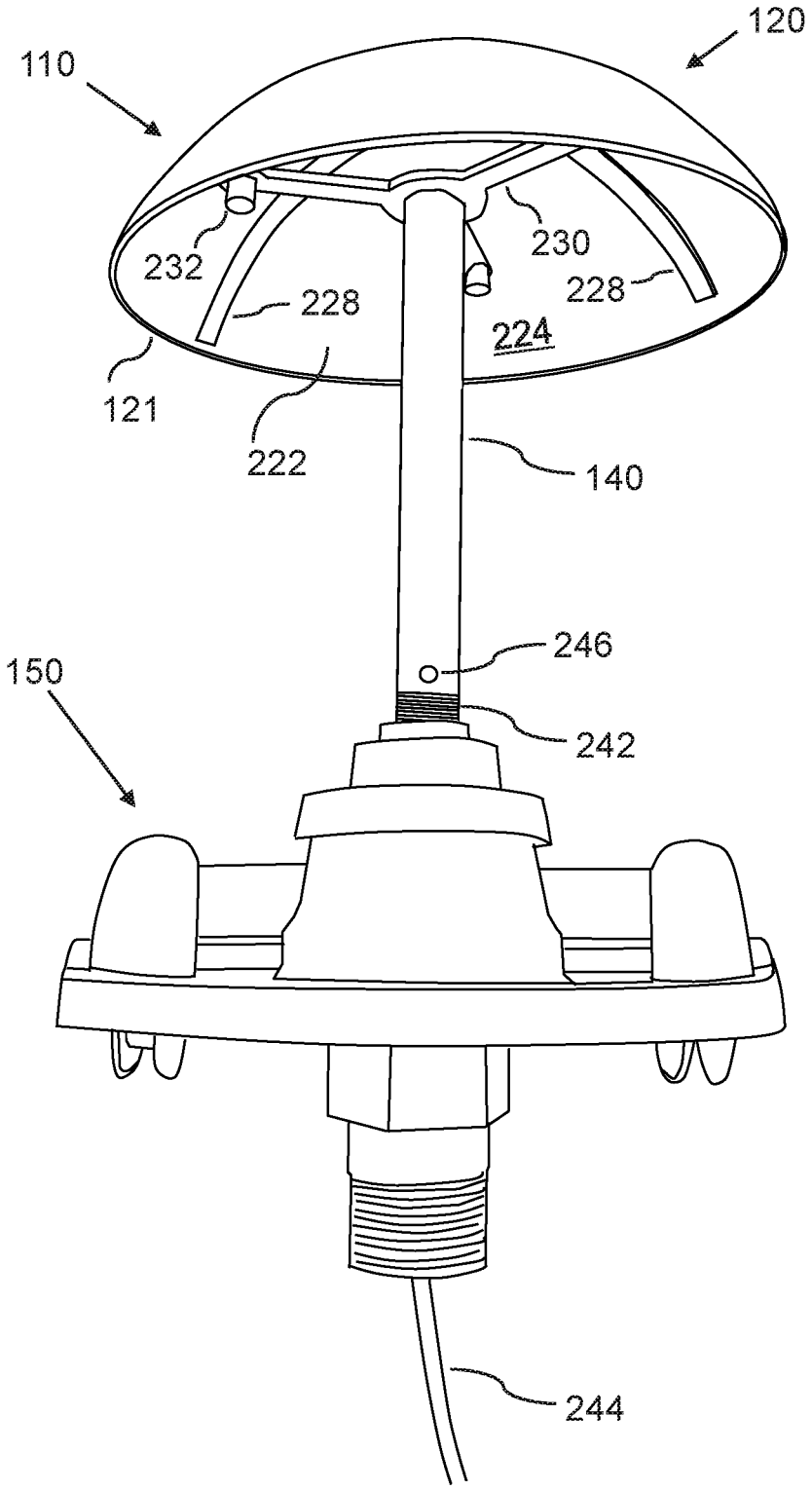
FIG. 2B is a perspective view of a flagpole lighting device that is installed on a flagpole, according to an embodiment of the invention.

In a related embodiment, as shown in FIGS. 2A and 2B, the at least one light source 228 can be a plurality of light emitting diode strips 228, which are mounted on the inner surface of the illumination dome.

In a further related embodiment, as shown in FIG. 3B, each of the light emitting diode strips 228 can be radially mounted, extending from a central area 342 of the inner surface 224 towards a rim 344 of the illumination dome.

In a further related embodiment, as shown in FIG. 3B, each of the light emitting diode strips can be mounted along a radial middle line 340 between a first mounting arm 338 and a second mounting arm 339, i.e. in a middle 340 between the first mounting arms 338 and the second mounting arm 339 such that there is an equal shortest distance to either the first mounting arms 338 and the second mounting arm 339 along the radial middle line 340.

In another related embodiment, as shown in FIGS. 2A and 2B, a lower end of the mounting stem 140 can include threading 242, such that the mounting stem 140 is configured to screw into a threaded aperture 252 of the flagpole truck 150.

Thus, in another related embodiment, as shown in FIGS. 2A, 2B, 3A, 3B, and 3C, a flagpole lighting device 110 can include:

a) A dome assembly 120, which comprises:
ii. an illumination dome 121; and
iii. at least one light source 228, which can be mounted inside (i.e. within) the illumination dome 121, i.e. in the interior of the illumination dome 121 between an opening 222 and an inner surface 224 of the illumination dome 121;

wherein the dome assembly 120 can be configured to be connected to a top end of a flagpole 160;

such that the dome assembly 120 is configured to be positioned with an opening 222 of the illumination dome 121 pointing downward, when the dome assembly 120 is connected to a top end of a flagpole 160;

such that light 118 from the at least one light source 228 is directed downward by the illumination dome 121, such that the flagpole lighting device provides lighting for a flag mounted on the flagpole 160, and such that the illumination dome 121 prevents emissions of upward directed light 118.

In related embodiments, the flagpole lighting device 110 replaces light fixtures that illuminate from the ground up. The flagpole lighting device 110 can be configured to use 24V DC, whereas many other flag lighting products use line voltage and are therefore less safe during installation and use. The flagpole lighting device 110 limits upward illumination and is therefore DARK SKY™ compliant and eligible for DARK SKY™ certification. Regardless of the position of the flag, the flagpole lighting device 110 remains stationary and provides lighting in a 360-degree span of illumination. The mounting stem 140 can include a weep hole 246 for drainage, and a wire exit aperture for installation of power wiring 244 to the at least one light source 228.

In related embodiments, the flagpole lighting device 110 can universally mount to different flagpole truck assemblies 150, as provided by various manufacturers.

Here has thus been described a multitude of embodiments of the flagpole lighting device 110, the flagpole lighting system 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A flagpole lighting device, comprising:

a) a mounting stem, which is configured to be connected to a flagpole truck that is mounted on a top of a flagpole; and b) a dome assembly, which comprises:
an illumination dome; and
at least one light source, which is mounted on an inner surface of the illumination dome; and c) a mounting structure, which comprises a central portion, wherein the mounting structure is connected to the inner surface of the illumination dome, such that the top end of the mounting stem is connected to the central portion of the mounting structure wherein the dome assembly is connected to a top end of the mounting stem;

such that the dome assembly is configured to be positioned with an opening of the illumination dome pointing downward, when a lower end of the mounting stem is connected to the flagpole truck, such that light from the at least one light source is directed downward by the illumination dome, such that the flagpole lighting device provides lighting for a flag mounted on the flagpole.

2. The flagpole lighting device of claim 1, wherein the mounting structure further comprises:

a plurality of mounting arms, which each extend radially from the central portion of the mounting structure, such that an outer end of each of the mounting arms is connected to the inner surface of the illumination dome.

3. The flagpole lighting device of claim 2, wherein the plurality of mounting arms comprises three mounting arms, which are symmetrically positioned around the central portion of the mounting structure.

4. The flagpole lighting device of claim 2, wherein the dome assembly further comprises:

a plurality of mounting receptacles, which are mounted on the inner surface of the illumination dome, such that the outer end of each of the mounting arms is connected to a corresponding mounting receptacle.

5. The flagpole lighting device of claim 4, wherein each of the mounting receptacles comprises:

a) a receptacle fastener; and b) a receptacle body, which comprises a receptacle aperture;

wherein the outer end of each of the mounting arms comprises a mounting aperture; and wherein the outer end of each of the mounting arms is connected to the receptacle body, such that the receptacle fastener protrudes through the mounting aperture and into the receptacle aperture.

6. The flagpole lighting device of claim 5, wherein each of the mounting receptacles comprises:

at least one body flange, which is connected to the receptacle body and to the inner surface of the illumination dome, such that the at least one body flange stabilizes the receptacle body.

7. The flagpole lighting device of claim 5, wherein the receptacle body is a hollow tube.

8. The flagpole lighting device of claim 5, wherein the receptacle fastener is a receptacle plug, which is permanently glued into the receptacle aperture.

9. The flagpole lighting device of claim 2, wherein the at least one light source is a plurality of light emitting diode strips, which are mounted on the inner surface of the illumination dome;

wherein each of the light emitting diode strips is radially mounted, extending from a central area of the inner surface towards a rim of the illumination dome; and wherein each of the light emitting diode strips is mounted along a radial middle line between a first mounting arm and a second mounting arm.

10. The flagpole lighting device of claim 1, wherein the central portion of the mounting structure further comprises a central aperture, which comprises a female threading;

wherein the mounting stem is hollow, such that the mounting stem comprises a stem aperture, which protrudes through the mounting stem;

wherein the top end of the mounting stem comprises a male threading;

such that the top end of the mounting stem is screwed into the central aperture of the mounting structure.

11. The flagpole lighting device of claim 10, further comprising:

a power wire, which protrudes through the mounting stem and the central aperture of the mounting structure, such that the power wire is connected to the at least one light source.

12. The flagpole lighting device of claim 1, wherein the at least one light source is a plurality of light emitting diode strips, which are mounted on the inner surface of the illumination dome.

13. The flagpole lighting device of claim 12, wherein each of the light emitting diode strips is radially mounted, extending from a central area of the inner surface towards a rim of the illumination dome.

14. The flagpole lighting device of claim 1, wherein the illumination dome is configured as a parabolic reflector, which is shaped as a segment of a circular paraboloid.

15. The flagpole lighting device of claim 1, wherein the illumination dome is configured as a spherical reflector, which is shaped as a segment of a sphere.

16. A flagpole lighting device, comprising:

a dome assembly, which comprises:

an illumination dome; and at least one light source, which is mounted inside the illumination dome;

wherein the dome assembly is configured to be connected to a top end of a flagpole;

a mounting stem, which is configured to be connected to a flagpole truck that is mounted on the top end of the flagpole; and a mounting structure, which comprises a central portion, wherein the mounting structure is connected to an inner surface of the illumination dome, such that the top end of the mounting stem is connected to the central portion of the mounting structure;

such that the dome assembly is configured to be positioned with an opening of the illumination dome pointing downward, when the dome assembly is connected to the top end of the flagpole, such that light from the at least one light source is directed downward by the illumination dome, such that the flagpole lighting device provides lighting for a flag mounted on the flagpole.

17. The flagpole lighting device of claim 16, wherein the mounting structure further comprises:

a plurality of mounting arms, which each extend radially from the central portion of the mounting structure, such that an outer end of each of the mounting arms is connected to the inner surface of the illumination dome.

18. The flagpole lighting device of claim 17, wherein the dome assembly further comprises:

a plurality of mounting receptacles, which are mounted on the inner surface of the illumination dome, such that the outer end of each of the mounting arms is connected to a corresponding mounting receptacle.

19. The flagpole lighting device of claim 17, wherein the at least one light source is a plurality of light emitting diode strips, which are mounted on the inner surface of the illumination dome;

wherein each of the light emitting diode strips is radially mounted, extending from a central area of the inner surface towards a rim of the illumination dome; and wherein each of the light emitting diode strips is mounted along a radial middle line between a first mounting arm and a second mounting arm.

20. The flagpole lighting device of claim 16, wherein the at least one light source is a plurality of light emitting diode strips, which are mounted on the inner surface of the illumination dome.

* * * * *